United States Patent [19]

Akiyoshi et al.

[11] 4,179,955

[45] Dec. 25, 1979

[54] POWER WRENCH

[75] Inventors: Toshio Akiyoshi; Tsutomu Onishi, both of Fukuoka; Shozo Haikawa, Kyoto, all of Japan

[73] Assignees: Mitsubishi Denki Kabushiki Kaisha, Tokyo; Kabushiki Kaisha Terauchi Seisakusho, Kyoto, both of Japan

[21] Appl. No.: 930,074

[22] Filed: Aug. 1, 1978

Related U.S. Application Data

[63] Continuation-in-part of Ser. No. 683,874, May 6, 1976, abandoned, which is a continuation of Ser. No. 450,921, Mar. 13, 1974, abandoned.

[51] Int. Cl.[2] ..... B25B 29/00

[52] U.S. Cl. ..... 81/57.11; 81/57.13

[58] Field of Search ..... 81/57.11–57.14, 81/57.29, 57.30, 56, 124.1; 74/640, 801, 800; 173/12

[56] References Cited

U.S. PATENT DOCUMENTS

| | | | |
|---|---|---|---|
| 1,326,627 | 12/1919 | Young | 81/57.31 |
| 1,386,455 | 8/1921 | Clemens | 81/57.11 |
| 1,970,179 | 8/1934 | Miller | 81/57.14 |
| 2,606,472 | 8/1952 | Curtis et al. | 81/57.11 |
| 2,820,382 | 1/1958 | Smith | 81/57.13 |
| 3,041,902 | 7/1962 | Wing | 81/56 |
| 3,222,954 | 12/1965 | Wuertz | 74/801 |
| 3,331,269 | 7/1967 | Sauter | 81/57.31 |
| 3,604,292 | 9/1971 | Sada | 81/57.11 |
| 4,003,274 | 1/1977 | Hirtsiefer | 74/768 |

OTHER PUBLICATIONS

Harmonic Drive (pp. 11 & 12), 1962, United Shoe Machinery.

*Primary Examiner*—James L. Jones, Jr.
*Attorney, Agent, or Firm*—Sughrue, Rothwell, Mion, Zinn and Macpeak

[57] ABSTRACT

A power wrench, or clamping tool, for tightening a bolt, nut and the like comprising a power shaft engaging the bolt, nut and the like, a driving power source of electromotive, pneumatic or hydraulic type, an anti-reaction force member for the prevention of rotation of the tool case due to the reaction force, a harmonic drive mechanism as the speed reduction mechanism between the power shaft and the driving power source, planetary gear device provided between the harmonic drive mechanism and the power shaft, a first mechanism engaged with a nut screwed to a torque set bolt and rotating the nut with the rotation of the power shaft thereby tightening the nut, a second mechanism engaged to the torque set bolt in such a way as to break the torque set bolt at a predetermined position when the tightening torque arrives at a predetermined value in the course of the clamping and a knock out mechanism which discharges the broken piece of the torque set bolt out of the case by means of a spring force. The tool case rotates with respect to a handle under relatively high frictional restraint to prevent the handle from rotation during the breakage or failure of the anti-reaction force member, and the anti-reaction force member is rotatable freely to a limited degree with respect to the tool case for locating the anti-reaction force member in contact with an adjacent nut and bolt to the nut being torqued down by the power wrench.

4 Claims, 16 Drawing Figures

POWER WRENCH

This application is a continuation-in-part application of application Ser. No. 683,874, filed May 6, 1976, now abandoned, entitled "CLAMPING TOOL" which application is a continuation application of application Ser. No. 450,921 filed Mar. 13, 1974, now abandoned, and entitled "CLAMPING TOOL".

FIELD OF THE INVENTION

This invention relates to a clamping tool or power wrench having a driving power source and a power shaft engaging, for example, with a bolt, nut or the like connected to said driving power source by way of a speed reduction mechanism.

DESCRIPTION OF THE PRIOR ART

This invention relates to a clamping tool or power wrench of electromotive, hydraulic and pneumatic type and the like which clamps a torque set bolt, usual bolt and the like to a clamped member.

In the known clamping tools or power wrenches of this type, the rotation of a driving power source is transmitted by way of a speed reduction device to a power shaft and clamping a body such as a bolt, nut, etc., is fitted to and rotated together with a power shaft to thereby tightly clamp said clamped body. In such a construction, however, when a tightening torque arrives at a predetermined level, the reaction force thereof is directly exerted on a worker carrying the tool to increase his fatigue. Some times, the reaction force even goes beyond the grasping force of the worker, which forces him to drop the tool to damage the same or even causes human accidents.

SUMMARY OF THE INVENTION

An object of this invention is to provide a power wrench or clamping tool having a driving power source and a power shaft engaging, for example, with a bolt, nut or the like connected to said driving power source by way of a speed reduction mechanism wherein said clamping tool is provided with an anti-reaction mechanism which prevents the rotation of the case of the clamping tool caused by the reaction force exerted on said case as the clamping proceeds.

Another object of this invention is to provide such clamping tool or power wrench in which a harmonic drive mechanism is used as a speed reduction mechanism in order to prevent the rotation of the case of the tool due to the reaction force generated at the time of clamping.

A further object of this invention is to provide a power wrench or clamping tool which is small in size and having a high reduction ratio.

A still further object of this invention is to provide such a power wrench or clamping tool in which the service life of the speed reduction mechanism is prolonged.

Another object of this invention is to provide a clamping tool or power wrench capable of discharging the unnecessary cut off portion of bolt, nut or the like out of the case of the tool.

These and other objects and advantages of this invention will become apparent by the following detailed description of this invention referring to the accompanying drawings.

DESCRIPTION OF THE PREFERRED EMBODIMENTS

Figure 1:
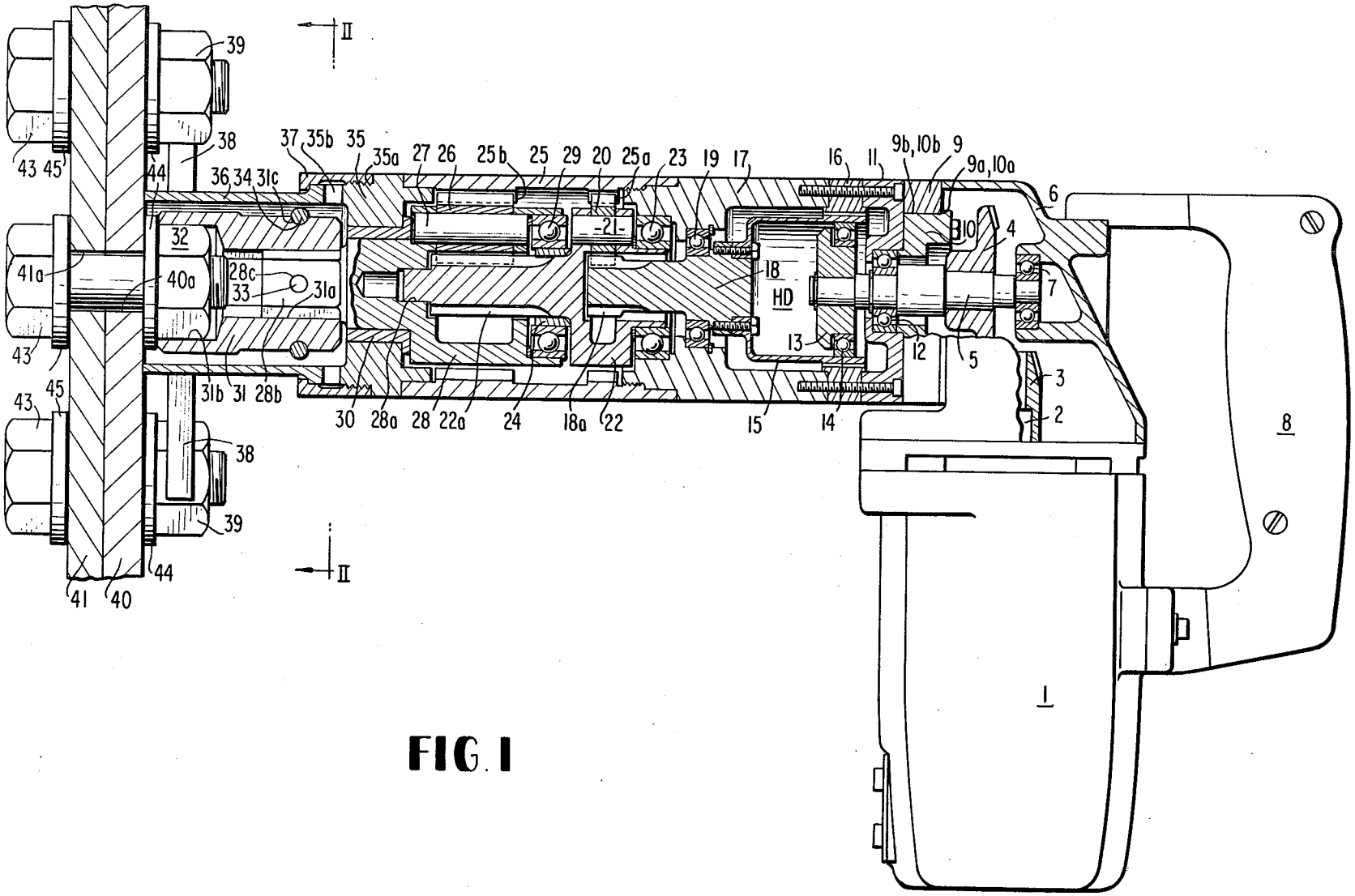
FIG. 1 is a partially cut away elevation of a first embodiment of the present invention.
Figure 2:
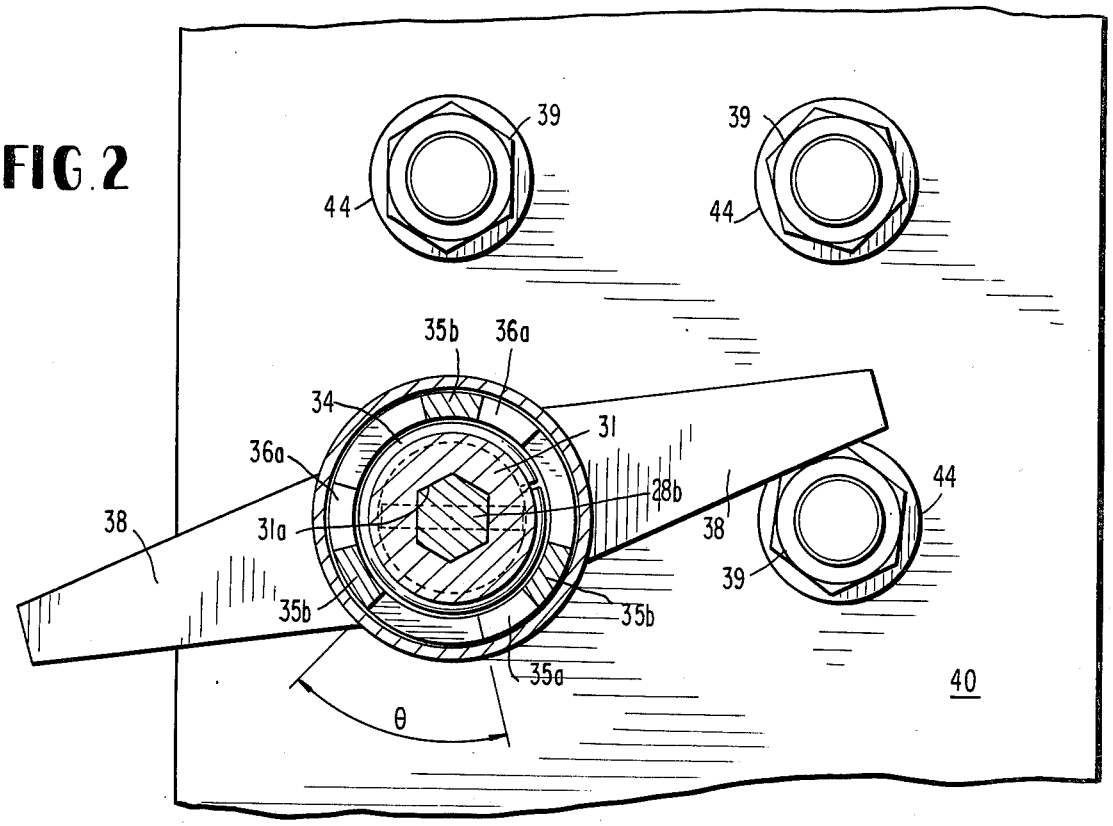
FIG. 2 is a section of a part of the embodiment shown in FIG. 1 taken along the line II—II of FIG. 1.

This invention is to be described in detail by way of preferred embodiments of a power wrench or power clamping tool, referring to the accompanying drawings, and at the first embodiment of this invention particularly referring to FIGS. 1 and 2, wherein reference numeral 1 denotes a frame for the driving power source such as an electric motor, hydraulic motor, pneumatic motor, etc. (not shown), 2 a rotating shaft for said driving power source, 3 a small bevel gear fitted in the proximate end of said rotating shaft 2, 4 a large bevel gear engaging said small bevel gear 3 and rotating at reduced speed, 5 a rotating shaft fitted to the large bevel gear 4, 6 a gear box connected to the frame 1, housing the small and large bevel gears 3 and 4 and supporting rotatably, the rotating shaft 5 by way of ball bearings 7. 8 denotes a handle riding over the frame 1 and the gear box 6, 9 a first stop plate connected to the gear box 6 and having sliding surfaces 9*a* and 9*b*. 10 denotes a second stop plate loosely engaging therein the rotating shaft 5 and having sliding surfaces 10*a* and 10*b* which slide with sliding surfaces 9*a* and 9*b* to each other. The first stop plate 9 and the second stop plate 10 define mating cylindrical high friction surfaces purposely resisting sliding therebetween except as a result of breakage or deformation of the anti-reaction member or bar 38. This structural feature is also provided in the other embodiments of this invention. In contrast, sleeve 36 to which the anti-rotation member or bar 38 is fixed, is rotatable relatively freely with respect to the second case 25 for limited rotation abouy an angle $\theta$, FIG. 2. 11 denotes a bearing support connected to the second stop plate 10 and rotatably supporting the rotating shaft 5 by way of ball bearing 12. HD identifies a well-known harmonic drive mechanism as a speed reduction device and composed of a wave generator, flexspline, internal gear and the like as described hereinafter. 13 denotes an elliptical wave generator fitted to the end of the rotating shaft 5, 14 ball bearings fitted to the outer periphery of the wave generator 13, 15 a flexspline of resilient material having U-shaped section, provided along the outer periphery of the ball bearings 14 and provided with predetermined numbers of external teeth at the outer cylindrical surface thereof. The flexspline 15 is connected to the ball bearing 14, while flexing in the shape of an ellipse so as to correspond with the outer periphery of the ball bearing 14. 16 denotes an internal gear which is connected to ball bearing support 11 and also provided with inner teeth engaging with the external teeth of flexspline 15 at the inner surface opposing to flexspline 15 and exceeding the number of inner teeth of felxspline 15 by one or two. 17 denotes a first case connected to internal gear 16, 18 a sun gear shaft connected to flexspline 15 and rotatably supported to the first case 17 by way of ball bearings 19. 18*a* denotes a first sun gear provided on the outer periphery of sun gear shaft 18, 20 are plural first planetary gears gearing with the first sun gear 18*a* and revolving with autorotation. 21 denotes a first planetary gear shaft which rotatably supports first planetary gears 20, 22 a first planetary gear stand on which the first planetary gear shaft is connected and which is, in turn, rotatably supported by metal ring 24, 22*a* denotes a second sun gear provided on the outer periphery of the top of the first planetary stand 22, 25 a second case connected to the first case 17, and 25*a* is a first internal gear provided at the inner periphery of the second case 25 and gearing with first planetary gear 20. 25*b* is a second internal gear provided at the other inner periphery of the second case 25 and 26 plural second planetary gears meshing with the internal gear 25*b* and which revolve with autorotation. 27 denotes a second planetary gear shaft which rotatably supports the second planetary gear 26 and which is, in turn, supported by metal ring 30. 28*a* denotes a circular hole or bore having a bottom end provided at one end of the inner periphery of the second planetary gear stand 28 and loosely engages the top of the first planetary stand 22 therein. 28*b* denotes a hexagonal projection formed at one end of the second planetary gear stand 28, 28*c* is an aperture passing through the center of the hexagonal projection 28*b*, 31 is a receptacle having at the inner periphery of one end thereof a hexagonal aperture 31*a* engaging the projection 28*b* of aforesaid hexagonal configuration, in which an aperture communicating the hexagonal aperture 28*c* is provided, and is formed with a hexagonal hole 31*b* engaging with a nut 32 at the inner periphery of the other end, 31*c* is a semi-circular ring groove formed at the outer periphery of receptacle 31, 33 is an anti-slip off pin for receptacle 31 provided within the aperture of receptacle 31 and aperture 28*c* in the hexagonal projection 28*b* and 34 an O-ring fitted to the ring groove 31*c* for the prevention of slipping off the pin 33. 35 denotes a bearing support connected at one end thereof to case 25 and fitted with metal ring 30 at the inner periphery thereof. 35*a* denotes a male screw formed at the outer periphery of the other end of the bearing support 35, 35*b* projections formed at the top of the other end of bearing support 35 at an interval of 120° as shown in FIG. 2, and 36 a sleeve provided around the outer periphery of receptacle 31 spaced apart concentrically therefrom ahd provided on one end thereof engaging portions 36*a* for engaging projections 35*b* of bearing support 35 at an internal of 120°. 37 denotes a joint to be screwed with the male screw 35*a* of bearing support 35 and detachably connecting sleeve 36 to bearing support 35. 38 is an anti-reaction force member coupled to sleeve 36 at an interval of 180° as shown in FIG. 2 and it is adapted so as to be capable of engaging an adjacent nut 39. 40 and 41 denote a pair of articles to be clamped, 43 a bolt inserted through apertures 40*a* and 41*a* for each of clamped articles 40 and 41 respectively and 44 and 45 washers loosely fitted to bolt 43, respectively.

The operation of the above described embodiment of the power wrench having the foregoing construction is to be described in clamping a pair of articles by way of bolt 43 and nut 42. A bolt 43 is inserted through apertures 40*a* and 41*a* of the clamped articles 40 and 41, and fitting up is effected by a nut 32 with fitting washers 44 and 45 to the bolt 43. The nut 32 is then fitted into a hexagonal hole 31*b* of a receptacle 31 and an anti-rotation member 38 is engaged with an adjacent nut 39 that was previously tightened to the clamped member 40. Then, by rotating a driving power source in the direction of clamping, a rotating shaft 2 is rotated. This rotation moment of said rotating shaft 2 is transmitted through a small bevel gear 3, a large bevel gear 4, a rotating shaft 5, a wave generator 13 and ball bearings 14 in speed reduction manner. The rotation of said ball bearings 13 expands the outer periphery of a flexspline 15 at two locations into an elliptic shape. The flexspline 15 meshes with an internal gear 16 and further reduced in speed. The rotation of the flexspline 15 is transmitted through a first sun gear shaft 18, a first sun gear 18*a*, a first planetary gear 20, a first planetary gear shaft 21, a first planetary gear stand 22, a second sun gear 22*a*, a second planetary gear 26, a second planetary gear shaft 27, and a second planetary gear stand 28 to a receptacle 31 and causes said receptacle to rotate at a reduced speed, thereby gradually screwing the nut 32 into the bolt 43 tightly thus to tighten the clamped articles 40 and 41. The receptacle 31 rotates at the rotation frequency N' represented by the following formula:

$$N' = \frac{Z_1}{Z_2} \cdot \frac{(Z_4 - Z_3)}{Z_3} \cdot \frac{1}{\left(1 + \frac{Z_6}{Z_5}\right)} \cdot \frac{1}{\left(1 + \frac{Z_8}{Z_7}\right)} \times N,$$

wherein N stands for the number of revolutions of the rotating shaft 2, $Z_1$ the number of teeth of the small bevel gear 3, $Z_2$ that of the large bevel gear 4, $Z_3$ that of the flexspline 15, $Z_4$ that of the internal gear 16, $Z_5$ that of the first sun gear 18*a*, $Z_6$ that of the first internal gear 2 5*a*, $Z_7$ that of the second sun gear 22*a* and $Z_8$ that of the second internal gear 25*b*.

As apparent from the equation above, the receptacle 31 is rotated at a greatly reduced speed and tightens the clamped article 40 and 41 with a great tightening torque. Then, as the tightening torque for the clamped articles 40 and 41 gradually increases, the reaction force of the tightening torque is also increased in proportion thereto but since the anti-rotation member 38 integrated with the tool body is engaged with the adjacent nut 39, the rotation of the tool due to the reaction force can be prevented and, therefore, the reaction force is not exerted to the worker who carry the tool.

It may some times occur during the clamping porcess such accidents that the bolt, to which the adjacent nut 36 engaged with the anti-rotation member 38 is screwed, is broken due to the fatigue caused by the reaction force of the tightening torque, or the anti-rotation member is disengaged from the adjacent nut 39 by the deformation, or further the anti-rotation member 38 itself is broken. In such cases, however, the first stop plate 9, the gear box 6 and the frame 1 are not rotated against the tendency of the tool to rotate due to the reaction force of the tightening torque although the rotation is allowed for the sleeve 36, the bearing support 35, the second case 25, the first case 17, the internal gear 16, the bearing support 11 and the second stop plate 10 because of the provision of the sliding surfaces 9*a*, 9*b*, 10*a* and 10*b* between the stop plates 9 and 10.

Figure 3:
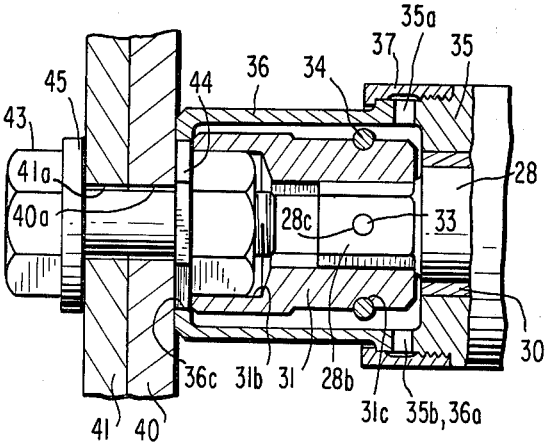
FIG. 3 is a partially cut away elevation of a second embodiment of this invention.

The second embodiment of this invention will now be described referring to FIG. 3, wherein the reference numeral 36 denotes a sleeve having at one end engaging portion 36*a* provided at an interval of 120° so as to engage with the projections 35*b* provided at the top of the bearing support 35 also at an interval of 120°, and having at the other end thereof a hexagonal engaging portion 36*c*. 44 is a hexagonal washer to be fitted to said hexagonal engaging hole 36*c* and tightly fitted to the bolt 43. Other constructions are omitted to explain since they are the same as the first embodiment.

In this second embodiment, a pair of articles to be clamped are clamped by way of a bolt 43 and a nut 32 as below: The bolt 43 is inserted through apertures 40*a* and 41*a* of the clamped articles 40 and 41, respectively, and a nut 32 is screwed to the bolt 43 with a washer 45 fitting to said bolt 43 and a hexagonal washer 44 fitting tightly to said bolt 43. Then, the nut 32 is fitted into the hexagonal hole 31*b* of the receptacle 31 while fitting the hexagonal washer 44 in the hexagonal fitting hole 36*a* and the receptacle is rotated just the same way as in the first embodiment. In this case, the nut 32 gradually tightens the clamped articles 40 and 41 being rotated by the receptacle 31 and the hexagonal washer 44 also tightens the clamped articles 40 and 41 gradually while moving axially around the outer periphery of the bolt 43 toward the clamped article 40 in the state locked to the sleeve 36 as the nut 32 moves. Thus, as the tightening torque to the clamped articles 40 and 41 increases gradually, the reaction force of said torque is also increased in proportion thereto. However, since the hexagonal engaging hole 36*c* is engaged with the hexagonal washer 44, the rotation of the tool due to the reaction force is inhibited and the reaction force is not exerted on the worker carrying the tool. In the case if the engagement between the hexagonal washer 44 and the sleeve 36 should be lost because of certain reasons in the course of clamping under the state described above, the handle 8 carried by the worker is not rotated since the sliding is effected at the sliding surfaces 9*a*, 9*b*, 10*a* and 10*b* between the first stop plate 9 and the second stop plate 10.

Figure 4:
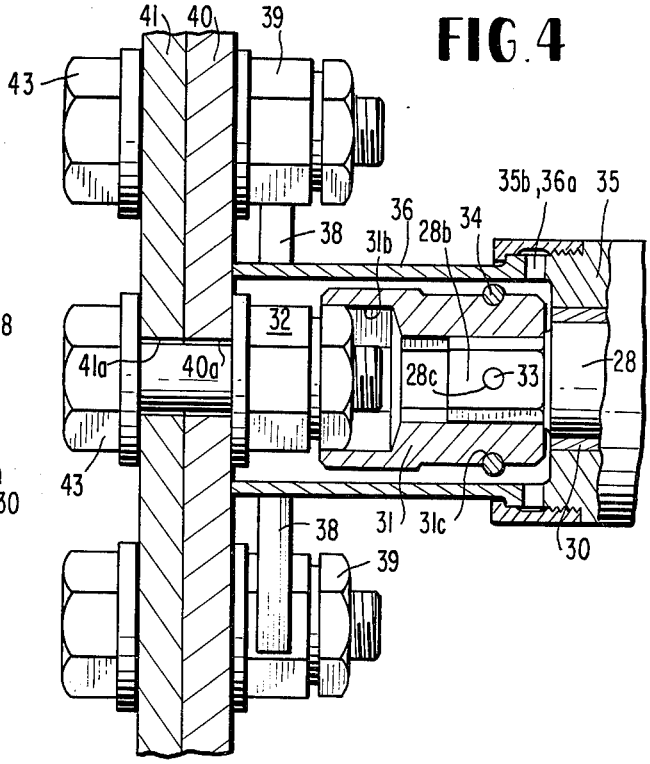
FIG. 4 is a partially cut away elevation of a third embodiment of this invention.

The third embodiment of this invention is to be described referring to FIG. 4, wherein a reference numeral 32 is a special nut which is screwed with a bolt 43. Other constructions and the operation thereof are omitted to be explained since they are quite the same as the first embodiment.

Figure 6:
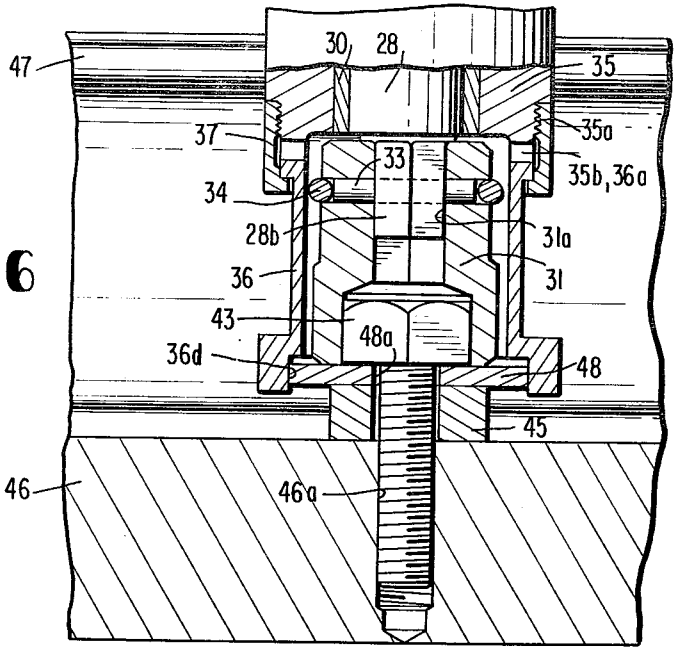
FIG. 6 is a section taken along line VI—VI of FIG. 5.
Figure 5:
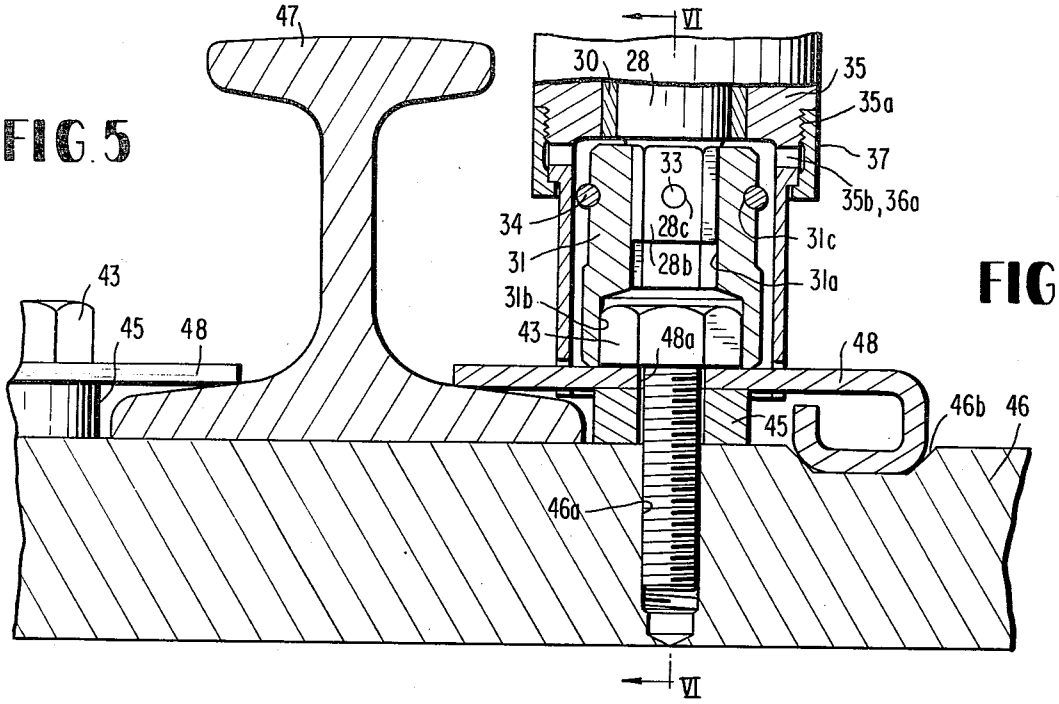
FIG. 5 is a partially cut away elevation of a fourth embodiment of this invention.

The fourth embodiment of this invention is to be described by referring to FIG. 5 and FIG. 6, wherein the reference numeral 46 denotes a cross tie made of steel material, for example, 46*a* female screws previously provided in the cross tie 46 (only one is shown in the drawing), 46*b* recesses provided in predetermined positions of the cross tie 46 (only one is shown in the drawing) and 47 a track mounted on the cross tie 46 and situated so as to locate at the intermediate of the female screw 46*a*. 45 denotes a hollow circular washer mounted just above the female screw 46*a*. 48 denotes a track clip abutting at one end thereof to the lower portion of track 47 and fitted at the other bent end into recess 46*b* of the cross tie 46, and it is mounted on washer 45. 48*a* is an aperture provided in the center of track clip 48, 43 a bolt screwing the track clip 48 into the female screw 46*a*, and 36 a sleeve having at one end thereof engaging portions 36*a* provided at an interval of 120° so as to engage with the projections 35*b* formed at the top of the bearing support 35 also at an interval of 120° and having at the other end an opening 36*d* of a dimension corresponding to the lateral size of track clip 48 as shown in FIG. 6. The other constructions are omitted to explain since they are the same as in the first embodiment of this invention.

In the above described embodiment having the foregoing construction, the track 47, for example, is clamped to the cross tie 46 by means of bolt 43 by way of track clip 48 as described below. The washer 45 is placed just above female screw 46*a* of cross tie 46. The track clip 38 is placed on the washer 45 with one end thereof fitted to the lower part of the track 47 and the other end being engaged into the recess 46*b* of the cross tie 46. Then, the bolt 43 is inserted through the aperture 48*b* of the track clip 48 and the aperture of the washer 45 and screwed into female screw 46*a* of the cross tie 46. In this condition, the hexagonal hole 31*b* of receptacle 31 is fitted to the head of bolt 43 and the opening 36*d* of sleeve 36 is fitted to track clip 48 and then the receptacle 31 is rotated in the same manner of operation as in the first embodiment. In this case, bolt 43 is rotated by receptacle 31 and gradually tightens track clip 48 to the cross tie 46. Thus, as the tightening torque to the track clip 48 gradually increases, the reaction force of the torque is also increased in proportion thereto. However, since sleeve 36 is engaged with track clip 48, rotation of the tool by means of reaction force is prevented and reaction force is not exerted on the worker carrying the tool.

In case if the engagement between track clip 48 and sleeve 36 should be lost for any reason in the course of the clamping work, the handle 8 carried by the worker would not be rotated since the sliding is effected at the sliding surfaces 9*a*, 9*b*, 10*a* and 10*b* between the first stop plate 9 and the second stop plate 10 as in the first embodiment.

Figure 8:
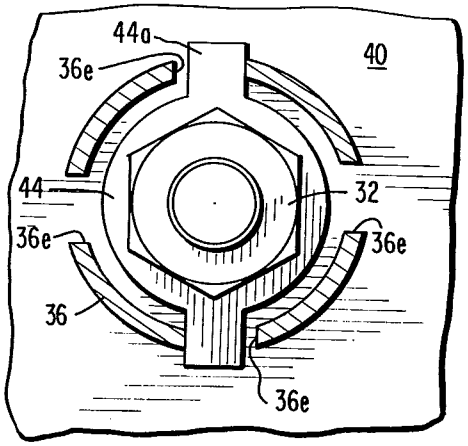
FIG. 8 is a section taken along line VIII—VIII of FIG. 7.
Figure 7:
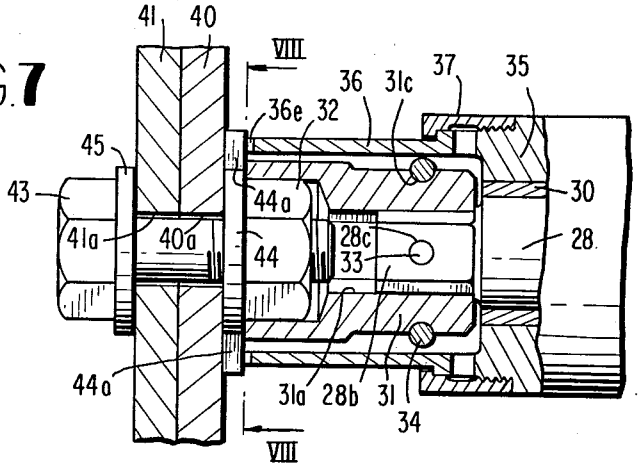
FIG. 7 is a partially cut away elevation of a fifth embodiment of this invention.

The fifth embodiment shown in FIGS. 7 and 8 is now to be described. In these figures, 35 denotes a sleeve having at one end thereof engaging positions formed at an interval of 120° so as to engage with the projections 35*b* formed at the top of bearing support 35 also at an interval of 120° and having at the other end thereof notched grooves 36*e* with predetermined depth and set at four positions symmetrical positions of the outer periphery thereof and tightly fitted to bolt 43. Other constructions are omitted to be explained since they are the same as in the first embodiment of this invention.

The operation of the foregoing embodiment is effected as below: Bolt 43 is inserted through apertures 40*a* and 41*a* of the articles to be clamped 40 and 41 and the nut 32 is screwed with bolt 43 with loosely fitting washer 45 to bolt 43 adn tightly fitting washer 44 to bolt 43. Then, nut 32 is fitted into the hexagonal hole 31*b* of receptacle 31 while engaging two notched grooves 36*e* of sleeve 36 to two projections 44*a* of washer 44 and the receptacle 31 is rotated in the same way as in the first embodiment. Nut 32, rotated by receptacle 31, gradually tightens the clamped articles 40 and 41 and washer 44 also tightens the clamped articles 40 and 41 by being moved axially around the outer periphery of bolt 43 toward the clamped article 40 in the state locked to the sleeve 36 as the nut 32 travels axially. Thus, as the tightening torque to the clamped articles 40 and 41 gradually increases, the reaction force of the torque is also increased. However, since the notched grooves 36*e* of the sleeve are engaged to the projections 44*a* of washer 44, rotation of the tool is prevented and the reaction force is not exerted on the worker carrying the tool. In the case if the projections 44*a* of the washer 44 are broken by fatigue in the course of proceeding the clamping work, the handle 8 carried by the worker would not be rotated since sliding is effected at the sliding surfaces 9*a*, 9*b*, 10*a* and 10*b* between stop plate 9 and stop plate 10 as in the first embodiment of this invention.

Figure 9:
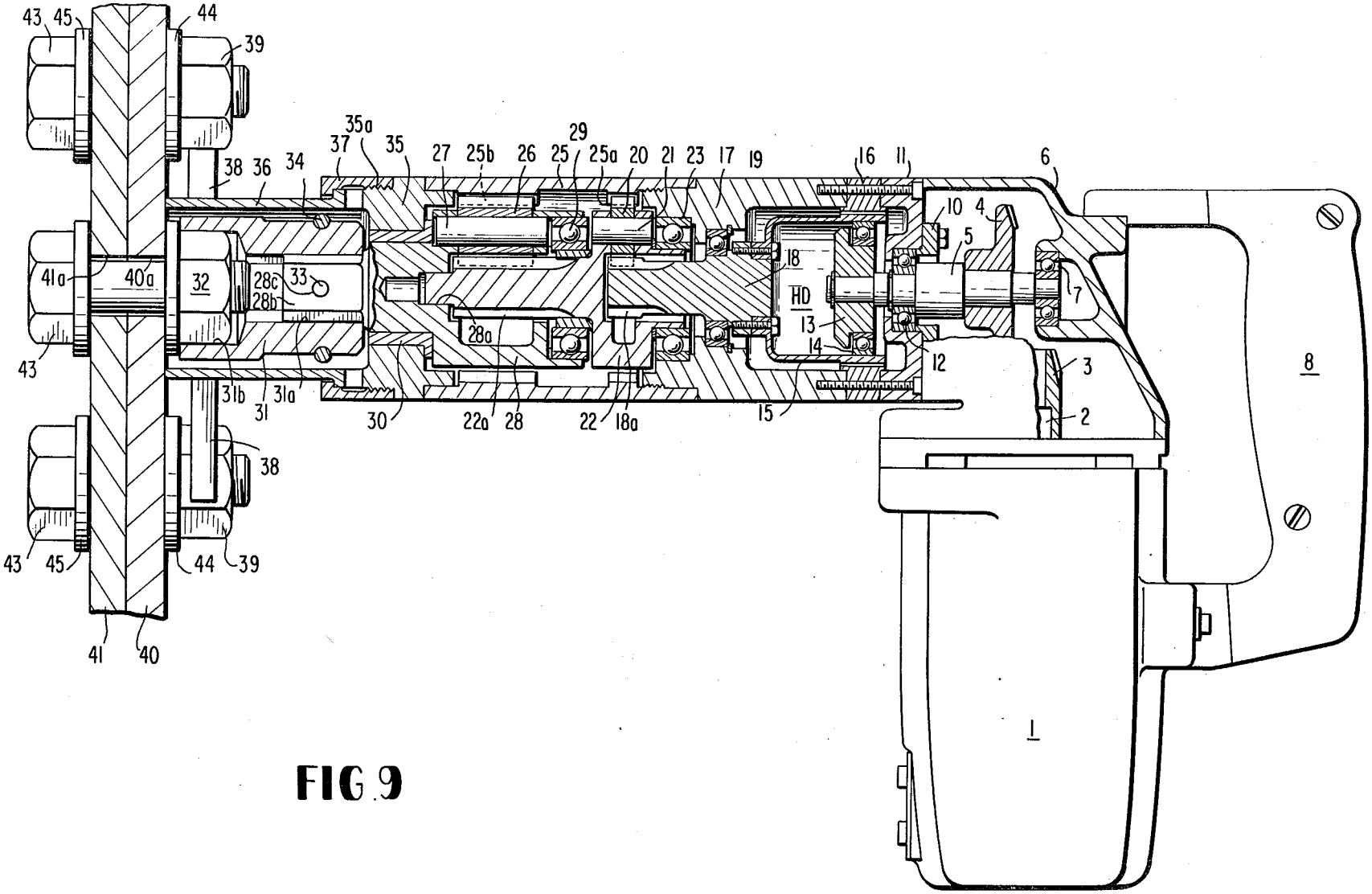
FIG. 9 is a partially cut away elevation of a sixth embodiment of this invention.

The sixth embodiment of this invention is to be described by referring to FIG. 9, wherein reference numeral 6 denotes a gear box containing a small bevel gear 3 and a large bevel gear 4 and connected at one end thereof to the frame and the other end thereof of the bearing support 11. 110 denotes a stop plate coupled to bearing support 11. Other constructions are the same as in the first embodiment of this invention, and therefore, explanation is omitted.

It is, however, of course, possible to replace sleeve 36 with one having hexagonal engaging hole 36*c* at the top thereof as described in the second embodiment and the washer 44 with a hexagonal washer. It is also possible to substitute track clip 48 for washer 44.

The operation of the above described embodiment having the foregoing construction is approximately the same as those of embodiments 1, 2 and 4, excepting that there are no rotations with the tool because of the absence of the sliding portions 9*a*, 9*b*, 10*a* and 10*b*.

Figure 10:
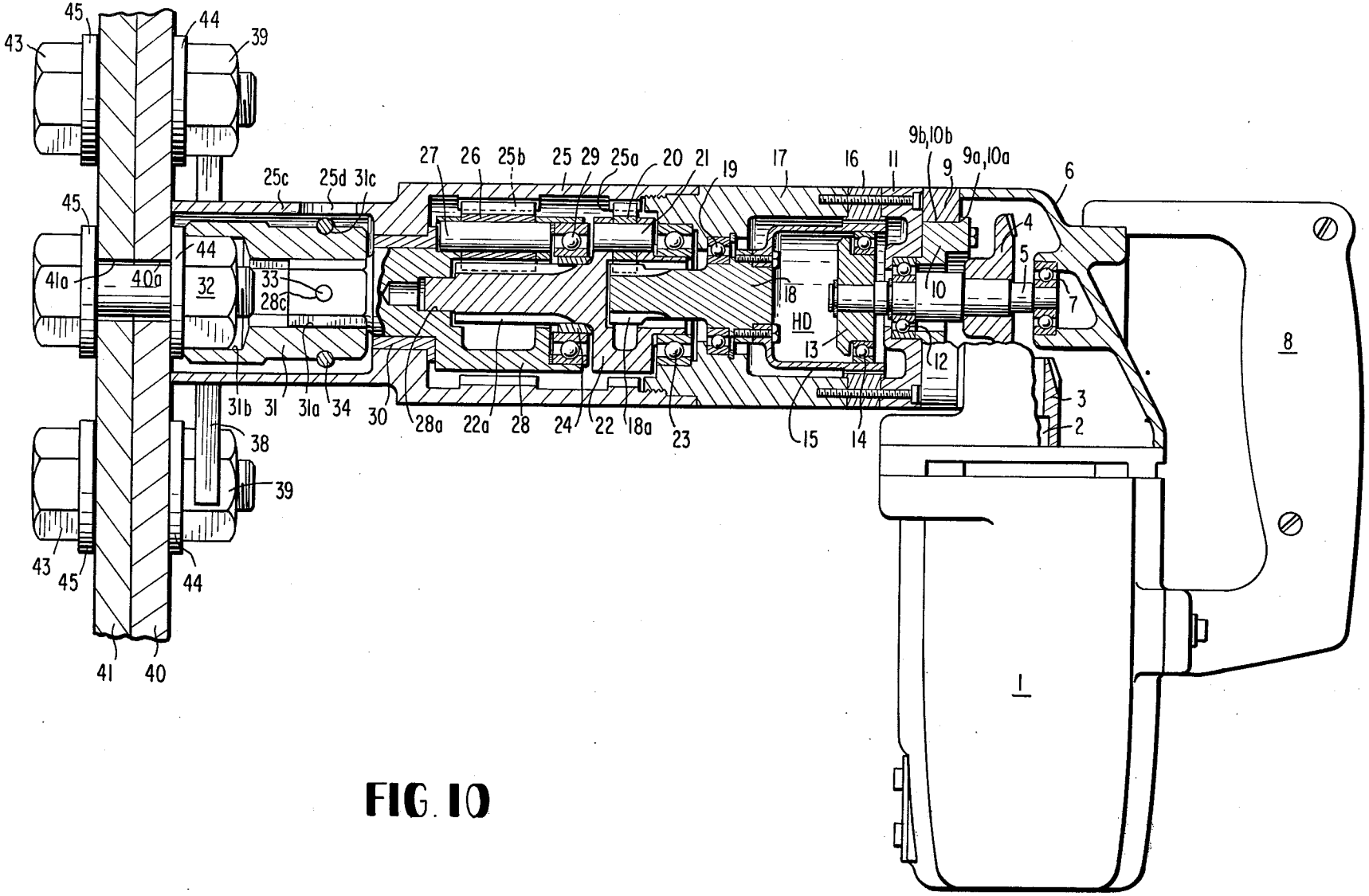
FIG. 10 is a partially cut away elevation of a seventh embodiment of this invention.

The seventh embodiment of this invention is to be described by referring to FIG. 10, wherein reference numeral 25*c* denotes a sleeve integratedly formed with the case 25 and connected with anti-reaction member 38 at an interval of 120° at the periphery thereof. 35*d* denotes an aperture provided through sleeve 25*c* for the insertion of pin 33 after engaged to the hexagonal projections 28*b* of the second planetary gear stand 28. Other constructions are not explained since they are the same as in the first embodiment.

The operation of the above described embodiment having the foregoing construction is approximately the same as in the first embodiment excepting that sleeve 25*c* neither rotates nor disengages solely since sleeve 25*c* is formed integratedly with the second case.

Figure 11:
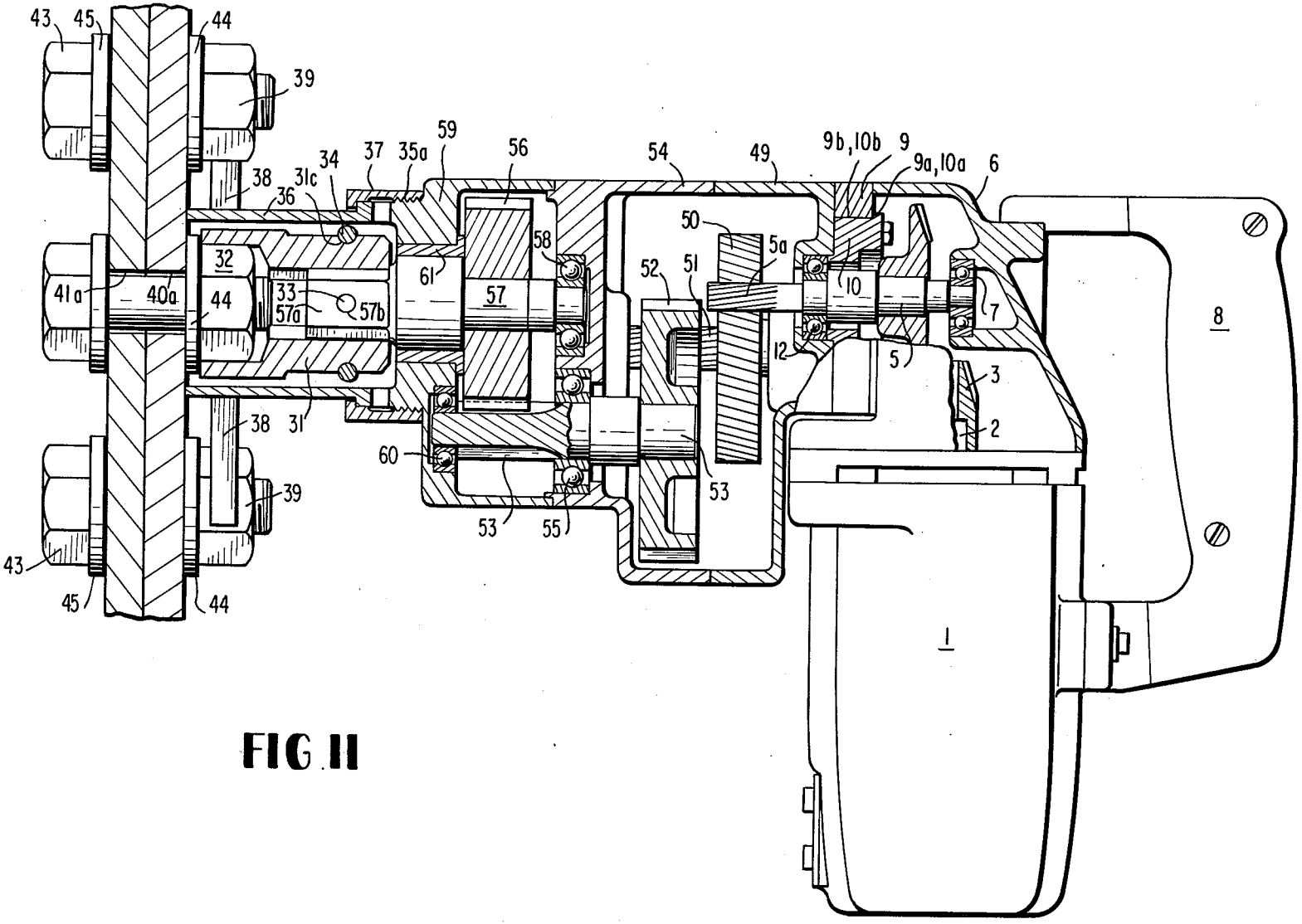
FIG. 11 is a partially cut away elevation of an eighth embodiment of this invention.

The eighth embodiment of this invention is to be described by referring to FIG. 11, wherein reference numeral 1 denotes a frame for the driving power source such as an electric motor, hydraulic motor, pneumatic motor, etc. (not shown), 2 a rotating shaft for the driving power source, 3 a small bevel gear fitted in the proximity of the end of the rotating shaft 2, 4 a large bevel gear engaging with small bevel gear 3 in the speed reduction manner, 5 a rotating shaft fitted to the large bevel gear 4, 5*a* a first gear formed at the top of the rotating shaft 5*a* a first gear formed at the top of rotating shaft 5*a*, 6 a first gear box connected to frame 1 and connecting small and large bevel gears 3 and 4, and it rotatably supports rotating shaft 5 by way of ball bearings 7. 8 denotes a handle coupled to frame 1 and a first gear box 6 overriding them, 9 a first stop plate connected to gear box 6 and having sliding surface 9*a* and 9*b*, and 10 a second stop plate loosely engaging therein rotating shaft 5 and having sliding surfaces 10*a* and 10*b* sliding to sliding surfaces 9*a* and 9*b* of the first stop plate 9. 49 is a second gear box connected to the second stop plate 10 and rotatably supporting rotating shaft 5 by way of ball bearings 12. 50 is a second gear engaging with the first gear 5*a* in the speed reduction manner and 51 a third gear fitted to second gear 50 and supported rotatably by way of a ball bearings (not shown). 52 denotes a fourth gear engaging with third gear 51 in a speed reduction manner and 53 is a rotating shaft fitted to fourth gear 52 and formed at one end thereof with a fifth gear 53*a*. 54 is a third gear box connected to second gear box 49, and it rotatably supports rotating shaft 53 and contains together with second gear box 49 the first, second, third and fourth gears 5*a*, 50, 51 and 52. 56 denotes a sixth gear engaging with fifth gear 53*a* in the speed reduction manner, and 57 a power shaft fitted to sixth gear 56 and supported rotatably at one end thereof to third gear box 54 by way of ball bearings 58. 57*a* denotes a hexagonal projection formed at the other end of power shaft 57. 57*b* an aperture provided through the center of hexagonal projection 57*a* and 59 a fourth gear box connected to third gear box 54, and it rotatably supports power shaft 57 by way of metal ring 61, 35*a* denotes a male screw formed at the outer periphery of one end of fourth gear box 59, and 35*b* projections provided at the top of fourth gear box 59 at an interval of 120° as shown in FIG. 2. Other constructions are omitted to be explained since they are the same as in the first embodiment of this invention. It is possible to replace sleeve 36 in this embodiment with one having at the top thereof a hexagonal engaging hole 36*c* as described in the second embodiment, and the washer 44 with a hexagonal washer. It is also possible to substitute sleeve 36 with one described in the fourth embodiment and the washer 44 with a track clip 48.

The operation of the above described embodiment having the foregoing construction is hereafter described for clamping the clamped articles 40 and 41 with bolt 43 and nut 32. Bolt 43 is inserted through apertures 40*a* and 41*a* of the clamped articles 40 and 41 and nut 32 is fitted with fitting washers 44 and 45 to the bolt to effect the fitting up. Then, nut 32 is fitted into the hexagonal hole 31*b* of the receptacle 31 and the anti-rotation member 38 is engaged to an adjacent nut 39 previously clamped to the clamped articles 40 and 41, and the rotating shaft 2 is rotated by rotating the driving power source in the direction of clamping. The rotation moment of rotating shaft 2 is transmitted through a small bevel gear 3, a large bevel gear 4, rotating shaft 5, a first gear 5*a*, a second gear 50, a third gear 51, a fourth gear 52, a rotating shaft 53, a fifth gear 53*a*, a sixth gear 56, and a power shaft 57 to the receptacle 31 and the receptacle 31 is rotated in reduced speed. Thus, the nut is gradually screwed to the bolt tightly thereby clamping a pair of the clamped articles 40 and 41 tightly. The receptacle 31 is rotated at the number of revolutions as represented by the following equation causing the nut 32 to rotate:

$$N' = \frac{Z_1 \cdot Z_3 \cdot Z_5 \cdot Z_7}{Z_2 \cdot Z_4 \cdot Z_6 \cdot Z_8} \times N$$

wherein N represents the number of revolutions of rotating shaft 2, $Z_1$ the number of the teeth of the small bevel gear 3, $Z_2$ that of the large bevel gear 3, $Z_3$ that of first gear 5*a*, $Z_4$ that of second gear 50, $Z_5$ that of third gear 51, $Z_6$ that of fourth gear 52, $Z_7$ that of fifth gear 53*a* and $Z_8$ that of sixth gear 56.

As apparent from the above equation, receptacle 31 rotates at a great speed reduction ratio and clamps the clamped articles 40 and 41 with a great tightening torque. Thus, as the tightening torque to the clamped articles 40 and 41 increases, the reaction force of the tightening torque is also increased in proportion thereto. However, rotation of the tool can be prevented and the reaction force of the torque is not exerted on the worker carrying the tool since the anti-rotation member integratedly formed with the tool is engaged with adjacent nut 39.

There may occur such an accident that the bolt screwed with adjacent nut 39 engaging with the anti-rotation member 38 integratedly formed with the tool is broken by the fatigue caused by the reaction force of the tightening torque, or the anti-rotation member 39 is disengaged from adjacent nut 39 due to the deformation or further, the anti-rotation member itself is broken in the course of proceeding with the clamping work. However, the first stop plate 9, first gear box 6, and the frame 1 are not rotated against the tendency of the tool to rotate due to the reaction force of the tightening torque although the sleeve 36, joint 37, the fourth gear box 59, the third gear box 54, the second gear box 49, and the second stop plate 10 are allowed to rotate because of the presence of the sliding surfaces 9*a*, 9*b*, 10*a* and 10*b* between stop plates 9 and 10.

Descriptions have been made for the operation of this embodiment with respect to the construction wherein the anti-reaction force member 38 is coupled to sleeve 36, but it is, of course, possible to replace sleeve 36 with one described in the second embodiment and substitute washer 44 with the hexagonal washer as used in the second embodiment to obtain the same anti-reaction force effect as in the second embodiment. It is also possible to replace sleeve 36 with the one described in the fourth embodiment and substitute the washer 44 with the track clip 48 as described in the same embodiment to obtain the same anti-reaction force effect as in the fourth embodiment.

Figures 12, 13:
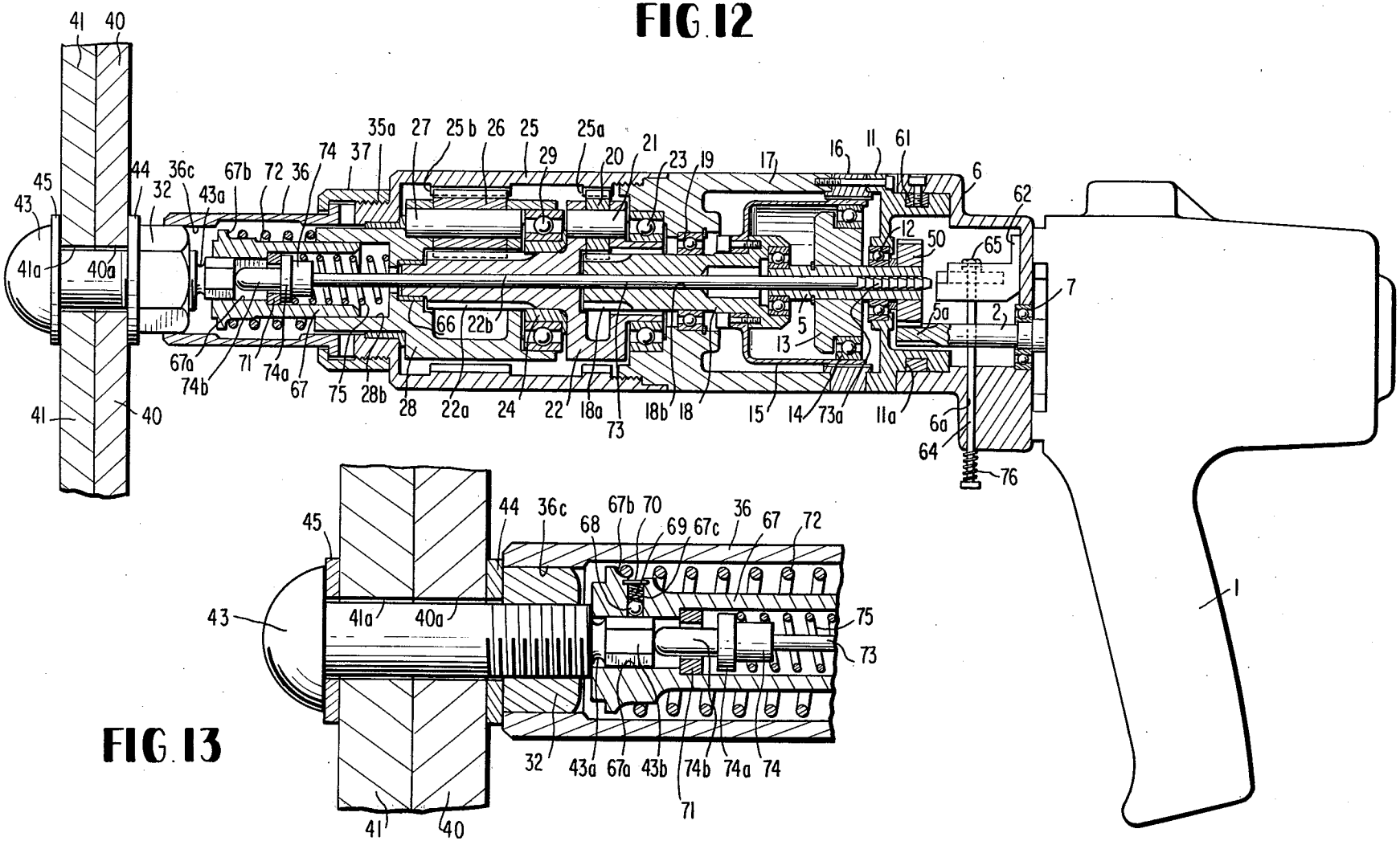
FIG. 12 shows a partially cut away elevation of a ninth embodiment of this invention at the early stage of fitting a nut sleeve to a nut.
FIG. 13 shows a section of a portion of the top of FIG. 12 as the nut sleeve is completely fitted to the nut.
Figure 14:
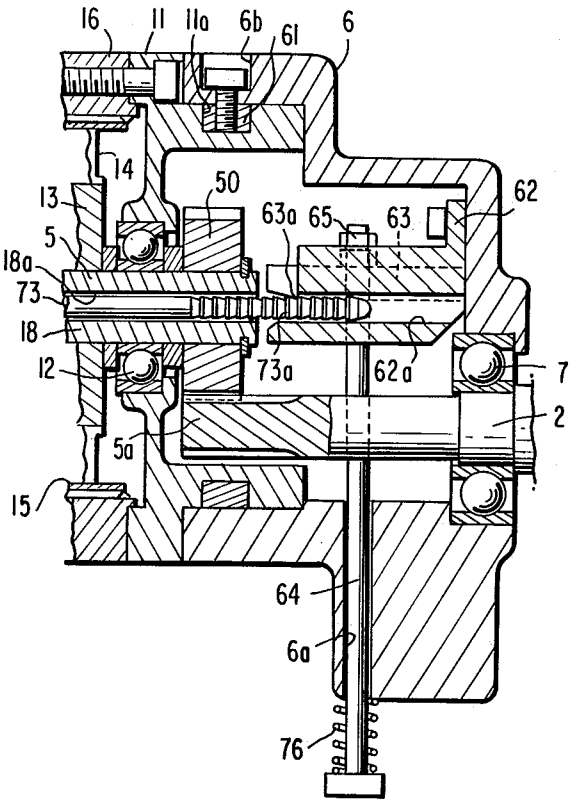
FIG. 14 shows a section of a portion of the rear end shown in FIG. 12 as the nut sleeve is completely fitted to the nut.

The ninth embodiment of this invention is to be described by referring to FIG. 12 through FIG 14, wherein reference numeral 1 denotes a frame for the driving power source such as an electric motor, hydraulic motor, pneumatic motor, and the like (not shown), 2 a rotating shaft of the driving power source, 5*a* a first gear provided at the top of shaft 2, 50 a second hollow gear engaging with first gear 5*a* in the speed reduction ratio, 5 a hollow rotating shaft fitted to second gear 50, and 6 a gear box connected to frame 1 and containing first gear 5*a* and second gear 50, and it rotatably supports rotating shaft 2 by way of ball bearing 7. 6*a* is an aperture provided through gear box 6, 6*b* a plurality of stepped apertures provided through the outer periphery of gear box 6 (only one of them is shown in the drawing), 61 a circular metal part fitted by screwing in the inner surface of stepped apertures 6*b*, and 62 a guide member connected to the inner surface of gear box 6 and provided with aperture 62*a* therethrough. 63 is an engaging member loosely fitted in the slotted groove (not shown) of guide member 62 and having at one end thereof an engaging pawl 63*a*. 64 is a lever moving up and down which is loosely inserted through aperture 6*a* of gear box 6 with one end thereof projecting outside of gear box 6 and the other end thereof being connected to engaging member 63 by a nut 65, and 11 a bearing support loosely fitted in the inner surface of gear box 6 and it includes a circular groove 11*a* for loosely engaging therein circular metal ring 61 and rotatably supports rotating shaft 5 by way of ball bearings 12. 13 is an elliptical wave generator fitted to rotating shaft 5, 14 ball bearings fitted to the outer periphery of wave generator 13, and 15 a flexspline consisting of resilient material having U-shaped section and provided at the outer periphery of ball bearings 14, and it is provided at the outer cylindrical surface thereof with predetermined number of teeth. This flexspline 15 is flexed in the elliptical configuration so as to correspond to ball bearings 14. 16 is an internal gear connected to bearing support 11 and provided at the inner surface thereof opposing said flexspline 15 inner teeth engaging with the external teeth of flexspline 15, the number of the inner teeth being greater than that of the external teeth by one or two. 17 is a first case connected to internal gear 16 and 18 is a sun gear shaft connected to flexspline 15 and having an aperture 18*b*, and it is connected rotatably to first case 17 by way of bearings 19. 18*a* is a first sun gear provided on the outer periphery of the sun gear shaft 18 and 66 is a ball bearing fitted to the inner surface of one end of the flexspline and rotatably supporting rotating shaft 5. 20 are plural first planetary gears engaging first sun gear case 18*a* and the planetary gears revolute with rotation, 21 is a first planetary gear shaft rotatably supporting the first planetary gear 20, and 22 is a first planetary gear stand having aperture 22*b* on which the first planetary gear shaft 21 is connected and supported and rotatably supported by the ball bearings 23 and metal ring 24. 22*a* denotes a second sun gear provided on the outer periphery of the top of the first planetary gear stand 22, 25 a second case connected to the first case, 25*a* a first internal gear provided on the inner surface of second case 25 and engaging with first planetary gear. 25*b* denotes a second internal gear provided on the other inner surface of second case 25 35*a* a male screw thread provided on the outer periphery of one end of the second case 25, 35*b* projections provided at the top of second case 25 at an interval of 120° as shown in FIG. 2 and 26 are plural second planetary gears engaging the second sun gear 22*a* and revolving under rotation while engaging the inner teeth 25*b*. 27 indicates a second planetary gear shaft rotatably supporting second planetary gear 26, and 28 is a second planetary gear stand on which the second planetary gear shaft 27 is connected and supported and which is, in turn, rotatably supported by the ball bearing 29 and metal ring 30. 28*a* is an aperture provided through the inner surface of the second planetary gear stand 28, and the aperture 28*a* is fitted with metal ring 66 which, in turn, rotatably supports one end of first planetary gear stand 22. 28*b* is a hexagonal recess provided on the inner surface of one end of the second planetary gear stand 28, and 67 is a hollow bolt having hexagonal outer periphery and axially slidable while being loosely inserted within the hexagonal recess 28*b*, the inner surface of one end thereof being provided with hexagonal hole 672 and the outer surface of the end thereof being formed with head portion 67*b*. 67*c* is an aperture provided at right angles with the hexagonal hole 67*a* of the hollow bolt receptacle 67, 68 a steel ball loosely engaged within aperture 67*c*, and 69 a compression coil spring intervened through aperture 67*c*, and 70 a cover provided on the upper part of aperture 67*c* for preventing the projection of the compression coil spring 69 from aperture 67*c*. 71 is a hollow stopper tightly fitted to the inner surface of bolt receptacle 67, and 72 is a compression coil spring intervened between the top of second planetary gear stand 28 and the stepped portion 67*b* of bolt receptacle 67, and spring 72 presses bolt receptacle 67 to the left in the drawing. 36 is a nut sleeve provided around the outer periphery of bolt receptacle 67 spaced apart concentrically, one end thereof being provided with engaging portions 36*a* that are formed at an interval of 120° so as to engage with projections 35*b* of second case 25 and the other end being provided with on the inner surface of the other end thereof hexagonal hole 36*c*. 73 is a rising rod adapted so as to pass through the aperture of rotation shaft 5, aperture 18*b* of sun gear shaft 18 and aperture 22*b* of the second planetary gear shaft and also adapted so that it can engage into the aperture 62*a* of guide member 62. 73*a* is an engaging portion provided on one end of the rising rod 73 and adapted to engage with the engaging pawl 63*a* of engaging member 63. 74 is an inertia weight connected to the other end of rising rod 73 the greater diameter portion of which is formed greater than that of the hole diameter of hollow stopper 71. 74*b* shows a top portion of insertia weight 74 that is connected to greater diameter portion 74*a* and the ouer periphery thereof is formed smaller than the hole diameter of stopper 71. 75 is a compression coil spring that is intervened between the botton end of the hexagonal hole 28*b* of second planetary gear stand 28 and the end face of the greater diameter portion 74*a* of inertia weight 74, and it rapidly moves rising rod 73 to the left in the drawing due to the inertia force of inertia weight 74 when the engaging portion 73*a* of rising rod 73 and the engaging pawl 63*a* of engaging member 63 disengage. 76 is a compression coil spring intervened between the outer periphery of gear box 6 and the projection of lever 64 for moving up and down, and it normally depresses engaging member 63 downward by way of lever 64 due to the spring force to thereby engage the engaging portion 73*a* of rising rod 73 to the engaging pawl 63*a* of engaging member 63. 40 and 41 are a pair of clamped articles having apertures 40*a* and 41*a*, respectively. 43 denotes a torque set bolt inserted through apertures 40*a* and 41*a*, 43*a* a smaller diameter portion formed on torque set bolt 43, and 43*b* a hexagonal projection provided at the top of the smaller diameter portion and the projection engaged into hexagonal hole 67*a* in bolt receptacle 67. 44 and 45 are a pair of washers loosely engaged to torque set bolt 43, and 32 a hexagonal nut screwed with torque set bolt 43, and nut 32 is fitted into the hexagonal hole 36*c* of nut sleeve 36. 37 is a joint screwed to the male screw 35*a* of second case 25.

The operation of the above described embodiment having the foregoing construction is hereinafter described. The torque set bolt 43 is loosely fitted with washer 45 at first and then inserted through respective apertures 40*a* and 41*a* of a pair of clamped articles 40 and 41. Then washer 44 is loosely fitted thereto, and the bolt is further screwed with hexagonal nut 32. After that, the hexagonal projection 43*b* of torque set bolt 43 is fitted into the hexagonal hole 67*a* of the bolt receptacle 67 and the hexagonal nut 32 is fitted into the hexagonal hole 36*c* of the nut sleeve 36. FIG. 12 represents the fitting state in the initial stage. By completely fitting the hexagonal nut 32 to the nut sleeve 36 and the torque set bolt 43 to the bolt receptacle 67, as shown in FIG. 13, the rising rod moves against the spring force of compression coil spring 75 to the right in the drawing and thus lifts engaging member 63 upward against the spring force of the compression spring coil spring 76 by the engaging portion 73*a* thereof to fit the same into aperture 62*a* through the guide member 62. The engaging member 63 again lowers due to the spring force of compression coil spring 76 to thereby engage the engaging portion 73*a* of rising rod 13 and the pawl of the engaging member 63 to attain the condition shown in FIG. 14. In this case, a clearance is formed between the tip portion 74*b* of the inertia weight 74 and the projections 43*b* of the torque set bolt 43.

Then, by the rotation of the driving power source in teh direction of clamping, the rotating shaft 2 and the first gear 5*a* are rotated. The rotation of the first gear 5*a* causes to rotate the second gear 50, rotating shaft 5 and a wave generator 13 and this rotation movement is transmitted through flexspline 15, first sun gear 18*a*, first planetary gear 20, first planetary gear shaft 21, first planetary gear stand 22, second sun gear 26, second planetary gear shaft 27, second planetary gear stand 28, and then to bolt receptacle 67. Since the bolt receptacle is fitted with the hexagonal projection 43*b* of the torque set botl 43, the rotation of the bolt receptacle 67 is hindered thereby causing internal gear 16 to rotate, bearing support 11, first case 17 second case 25, joint 37, nut sleeve 36 thus to rotate the nut 32. Then, the clamped articles 40 and 41 are gradually clamped by way of washer 44. Thus, as the tightening torque to the clamped articles 40 and 41 increases, the reaction force exerted on the torque set bolt 43 is also increased in proportion thereto. When the tightening torque exceeds a predetermined value, the smaller diameter portion 43*a* of the torque set bolt 43 is broken and a pair of the clamped articles 40 and 41 are tightened with a prescribed tightening torque, while the hexagonal projection portion 43*b* of the torque set bolt 43 as a broken place is pressed by a steel ball 68 which is, in turn, pressed by the compression coil spring 69 inserted through aperture 67*c* in the bolt receptacle 67 and stopped still. When the torque set bolt is broken, the inhibition to rotation of the bolt receptacle 67 is removed and the bolt receptacle 67 is released and therefore rotates under nonloaded condition. On the contrary, the nut sleeve 36, second case 25, first case 17, internal gear 16, bearing support 11 stop rotation. Finally, the driving power source is stopped and the clamping tool is moved to the side of the clamped articles to disengage the nut 32 from the nut sleeve 36. Then, with raising of the lever 64 against the spring force of the compression coil spring 76 upward, the engaging member 63 is elevated to disengage itself from the engaging portion 73*a* of the rising rod 73, thereby rapidly moving the rising rod 73 by the spring force of the compression coil spring 75 and the inertia of the inertia weight 74 to the side of the broken piece so as to discharge the piece outside of the clamping tool.

Figure 15:
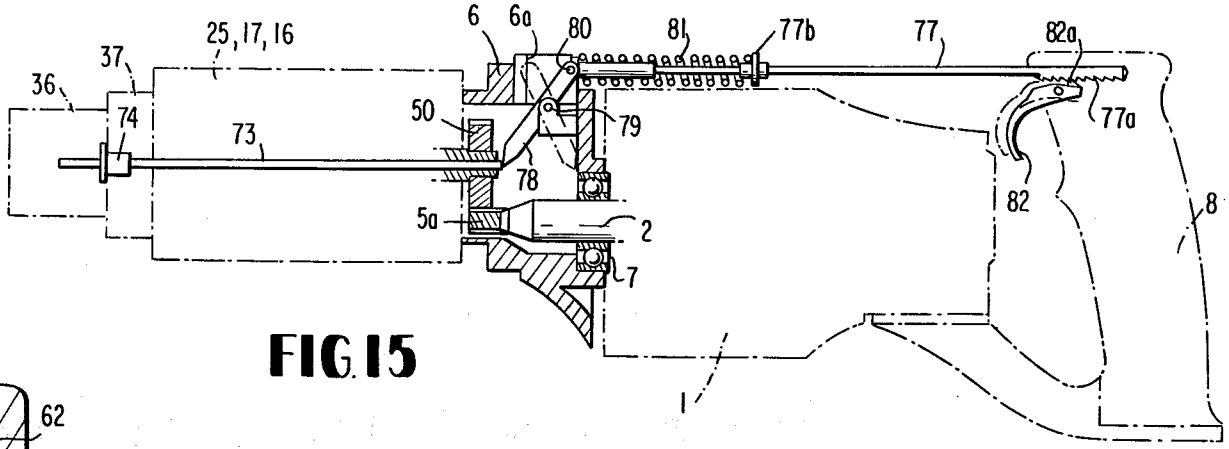
FIG. 15 is a partially cut away elevation of a tenth embodiment of this invention.

The tenth embodiment of this invention is to be described by referring to FIG. 15, wherein reference numeral 73 denotes a rising rod, the top of which is adapted so as to freely pass through the bolt receptacle (not shown). 77 is a moving frame movably provided outside of frame 1 and the one end thereof is provided with a rack 77*a* inserted through handle 8. 77*b* is a flange formed at an intermediate portion of moving rod 77 and 6 is a gear box connected to frame 1 and having opening 6*a*. 78 denotes a push lever pivoted to gear box 6 by way of a pin 79, 80 a pin for hinging the moving lever 77 and push lever 78, 81 a compression spring coil intervened between flange 77*b* and push lever 78, and 81 a pivot handle having an engaging portion 82*a* for the engagement of rack 77*a* of moving lever 77. Other constructions are not explained since they are the same as in the ninth embodiment. The operation of the above described embodiment is to be hereinafter described. When bolt receptacle 67 is fitted to the hexagonal projection 43*b* of the torque set bolt 43 in clamping the torque set bolt 43, the rising rod 73 retracts to rotate the push lever 78 to the location shown in the dotted line and thereby advancing the moving lever 77 against the spring force of the compression coil spring 81. In other words, the spring energy of compression coil spring 81 is stored thereby and the moving position is kept by engagement between the engaging portion 82*a* of the pivot handle 82 and the rack 77*a*. In the same operation as described in the foregoing ninth embodiment, the clamped articles 40 and 41 are tightened by an appropriate tightening torque to break the smaller diameter portion 43*a* of the torque set bolt 43. In this state, the driving power source is stopped, the engagement between the nut sleeve 36 and the nut 32 is released and the pivot handle 82 is pivoted to the position shown by the dotted line. Then, the rack 77*a* is freed from the engaging portion 82*a* and moved by means of the spring force of the compression coil spring 81 to the side of handle 8, while push lever 78 pivots to the position shown by the solid line, thereby causing the rising rod 73 to move to the side of the bolt receptacle 67 and discharge the broken piece by means of the top portion 74*b* of the inertia weight 74 outside of the tool. Other operations are the same as in the ninth embodiment and, therefore, omitted here.

Figure 16:
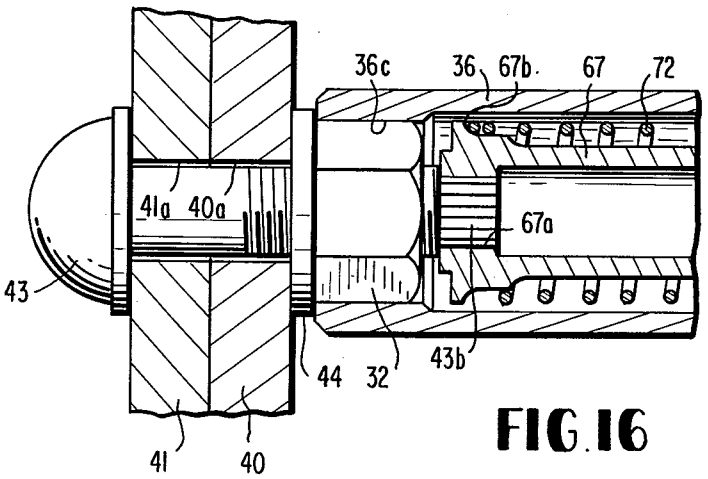
FIG. 16 is a partially cut away elevation of an eleventh embodiment of this invention.

The eleventh embodiment of this invention is to be described referring to FIG. 16, wherein reference numeral 43 is a bolt inserted through apertures 40*a* and 41*a* of the clamped articles 40 and 41 and having at the top thereof a hexagonal projection 43*b*, 32 a hexagonal nut screwed to bolt 43 by way of a washer 44, 36 a nut sleeve engaged to the hexagonal nut 32 and having hexagonal holes 36*c* at the inner surface thereof, and 67 a bolt receptacle having hexagonal hole 67*a* fitted with the hexagonal projection 43*b*. Other constructions are omitted here since they are the same as in the ninth embodiment of this invention.

In the above described embodiment, the bolt 43 is inserted through apertures 40*a* and 41*a* of the clamped articles 40 and 41, and the hexagonal nut 32 is screwed to the bolt 43 by way of the washer 44. Then, the nut sleeve 36 is fitted to the nut 32 and the bolt receptacle 67 is fitted to the bolt 43 and the driving power source is rotated in the direction of clamping. Then, the nut sleeve 36 is rotated by the rotation of the power source and gradually tightens the clamped articles 40 and 41. Since the bolt 43 is held by the bolt receptacle 67, slipping can be prevented and nut 32 is tightened to the clamped articles 40 and 41. Other operations are the same as in the ninth embodiment and, therefore, omitted.

Operation of the embodiment has been described with respect to the clamping of the clamped articles, the loosening of the clamped articles can be effected in similar procedures by reversely rotating the driving power source.

The power wrench according to this invention having the foregoing construction can provide a high speed reduction ratio and can clamp the clamped articles with a great torque. It is of reduced size and light weight and enables easy maintenance and inspection. In addition, since an anti-rotation portion is provided on the tool, the rotation of the tool due to the reaction force of the tightening torque can be prevented and the fatigue of the tool carrying worker is greatly reduced. Moreover, since the stationary portion of the speed reduction mechanism is made to rotate relative to the handling portion, the handling portion is not rotated even if the portion of the tool is rotated by the reaction force of the tightening torque in case the anti-rotation portion should fail to serve its function. Such a double safety mechanism as above can prevent the damage on the tool or the occurrence of the human accidents due to the reaction force of the reaction torque. Further, since a sleeve is provided to the stationary portion of the speed reduction mechanism detachably and pivotally in a predetermined angle in the tool of this invention, the anti-rotation portion can be rotated within this angle and thus can select the adjacent nut to be engaged with the anti-rotation portion in a certain range. Also the sleeve and receptacle can be replaced depending on the diameter of the nut and bolt. In addition, in the embodiment of the power wrench of this invention in which the torque set bolt is used, a rising rod having inertia weight and moving axially, a spring means forcing the rising rod to the torque set bolt, engaging mechanism regulating the movement of the rising rod, and the engagement releasing mechanism for releasing the engaging mechanism. Therefore, by the release of the engagement release mechanism, the broken piece of the torque set bolt can be positively discharged outside of the tool by the strong stroke of the rising rod due to the resilient force of the spring means stored therein.

While the invention has been described in detail and with reference to specific embodiments thereof, it will be apparent to one skilled in the art that various changes and modifications can be made therein without departing from the spirit and scope of the invention.

What is claimed is:

1. A power wrench comprising:

a frame carrying a motor, a handle secured to said frame, at least one speed reduction gear means having an input and an output, said input operatively coupled to said motor, a case accommodating said speed reduction gear means, a receptacle coupled to the output of said speed reduction gear means and projecting from one end of said case for engagement with a threaded rotatable workpiece element to be clamped and supported by a stationary element, a sleeve mounted to one end of said case for rotation with said case and surrounding the periphery of said receptacle, a bar-shaped anti-rotation member for rotation with said sleeve and projecting radially outwardly therefrom for engagement with said stationary element supporting said threaded rotatable workpiece, and means for rotatably mounting said case to said frame under a predetermined frictional restraint at the input of said speed reduction gear means;

whereby, said anti-rotation member prevents rotation of the case due to clamping reaction force, but upon deformation or breaking of the anti-rotation member, said case rotates relative to said frame and said handle overcoming the frictional restraint to prevent clamping reaction torque transmission to the power wrench operator, and said power wrench further comprising means for mounting said sleeve for relative free rotation with respect to said case within a predetermined angle to permit said bar-shaped anti-rotation member to be rotated slightly during engagement of said receptacle to said threaded rotatable work piece without rotation of said case due to said predetermined frictional restraint and to thereby eliminate the necessity of rotating the handle to cause said anti-rotation member to move out of the way of a portion of the stationary element which would otherwise prevent said engagement.

2. The power wrench as claimed in claim 1, further comprising means for detachably mounting said sleeve to said case.

3. The power wrench as claimed in claim 1, wherein said at least one speed reduction gear means comprises a planetary gear.

4. The power wrench as claimed in claim 1, wherein said at least one speed reduction gear means comprises a planetary gear means and a harmonic drive means.

* * * * *